US008479472B1

(12) United States Patent
LeFever et al.

(10) Patent No.: US 8,479,472 B1
(45) Date of Patent: Jul. 9, 2013

(54) INTERIOR SURFACE SYSTEM AND METHOD

(75) Inventors: Travis A. LeFever, Greensboro, NC (US); Daniel Melvin Cook, Jamestown, NC (US)

(73) Assignee: Crossway Coatings, Inc., Greensboro, NC (US)

( * ) Notice: Subject to any disclaimer, the term of this patent is extended or adjusted under 35 U.S.C. 154(b) by 87 days.

(21) Appl. No.: 13/163,361

(22) Filed: Jun. 17, 2011

Related U.S. Application Data

(60) Provisional application No. 61/476,108, filed on Apr. 15, 2011.

(51) Int. Cl.
*E04B 1/00* (2006.01)
*E04B 2/00* (2006.01)

(52) U.S. Cl.
USPC ..... 52/741.1; 52/417; 52/415; 52/396.04

(58) Field of Classification Search
USPC ..... 52/741.1, 417, 415, 396.04
See application file for complete search history.

(56) References Cited

U.S. PATENT DOCUMENTS 3,341,878 A * 9/1967 Hubbard ..... 15/235.4
3,503,784 A * 3/1970 Morita Eiichi et al. ..... 442/63
3,725,120 A * 4/1973 Suter ..... 8/424.6
3,761,992 A * 10/1973 Schneller ..... 15/210.1
4,657,594 A * 4/1987 Struss ..... 106/409
4,686,253 A * 8/1987 Struss et al. ..... 524/44
6,880,198 B1 * 4/2005 Hazard ..... 15/235.7
7,836,652 B2 * 11/2010 Futterman ..... 52/417
2008/0176469 A1 * 7/2008 Dong et al. ..... 442/58
2009/0148683 A1 * 6/2009 Ilfrey ..... 428/215

OTHER PUBLICATIONS

*Article from Magazine Coatings Pro Magazine* http://cp/coatingspromag.com/wps/portal/cpro/c1/hc7RColwGAXgR_p_56Z2OQuljBJbtX . . . dated Jul. 25, 2011.

* cited by examiner

*Primary Examiner* — Mark Wendell
(74) *Attorney, Agent, or Firm* — Michael A. Mann; Nexsen Pruet, LLC

(57) ABSTRACT

A method and composition for reconditioning the inner surfaces of a facility. After removing loose material, corrosion and rust by abrading the surface, repairs are made to the surface. Gaps, cracks, and pits are filled and transitions from one surface material to another are smoothed with putties; holes and complex areas of the surface are filled with expanding foams and shaped to contour; and sheet metal is added where corrosion and rust have left extensive weakened areas in the surface. A corrosion inhibitor such as aluminum flakes or micaceous iron oxide is applied to the shaped surface followed by a structural coating of polyurea or elastomeric urethane and top coat of moisture cured urethane or polyaspartic acid that adds an additional water barrier and increases that surface shaping to shed water. The combination of these layers results in a surface with improved robustness against frequent cleaning.

33 Claims, 2 Drawing Sheets

INTERIOR SURFACE SYSTEM AND METHOD

PRIORITY CLAIM

Priority is claimed to U.S. provisional patent application Ser. No. 61/476,108 filed Apr. 15, 2011, which is incorporated herein in its entirety by reference.

BACKGROUND OF THE INVENTION

In both commercial and industrial facilities, particularly those that process food, the interior surfaces, such as the walls, are subject to frequent cleaning. The surfaces are cleaned with hot water, typically at least 140° F. and often as much as 160° F. Detergents, often containing chlorine, are used in the hot water to emulsify grease and kill bacteria. Over time, the combination of chemicals and hot water deteriorate the finishes on these interior surfaces. For example, a paint finish begins to crack, peel and chip or may be marred. The walls, often constructed of insulated metal panels in those facilities that process foods at colder temperatures, may have begun to rust and corrode. There may also be holes or dents in the walls or seams between various construction materials that trap water and bacteria, and are difficult to clean.

The facility owner may then decide, perhaps urged by health inspectors, to recondition the facility. Often reconditioning is limited to simple and traditional painting because a prolonged shutdown of production operations for more extensive reconditioning efforts is prohibitive. Eventually, the facility may become so deteriorated that complete reconditioning is required, assuming that the facility can be reconditioned at all.

There is thus a need for a way to recondition such facilities that is more durable than traditional and simple painting but which can be completed without loss of production time so as not to impede facility operations.

SUMMARY OF THE INVENTION

According to its major aspects and briefly recited, the present invention is a method for reconditioning a facility. In fact, the present method may be beneficially applied to a new facility or at least to one that does not already need to be reconditioned because its application improves the robustness of the interior surfaces of that facility to better withstand the deterioration caused by frequent cleaning. Furthermore, the cleaning will be more effective and the condition of the rehabilitated surface will be more sustainable, thereby substantially extending the interval before it needs to be reconditioned.

The present invention is also a composition made by a process in which layers are applied to an interior surface in such a way that they bind together and result in a new surface that is a highly impervious barrier to moisture. This more robust surface sheds water quickly and will resist the penetration of oft-applied water despite the use of hot-water detergents, including chlorine-containing detergents, and prolonged exposure to ultraviolet light.

The present method improves the topography of the interior surface, transforming it from rough and angular to one that is smooth and continuous, with no abrupt edges, gaps, or distinct changes in direction. Corners and edges are rounded, and the radius of curvature at locations where there were abrupt changes in surface direction is increased, gaps and holes are filled with expandable plastic foam and then sculpted to transition smoothly to surrounding surfaces, and topographic transitions are smoothed with putty. Depending on the integrity of the underlying structure, sheet metal may be applied to portions of the surface to improve or restore structural strength.

In addition to re-shaping the surface, the components applied to it form a significant bi-directional obstacle (much desired in industry) to air and water intrusion that prevents rot and corrosion of underlying structural materials. The components are applied in a manner that binds them together to avoid delamination and to deny inter-layer pathways for water intrusion. In addition, the components prevent deteriorated construction materials (peeling paint, for example) from befouling process areas.

The present method can also be completed quickly, perhaps within a weekend. Indeed, several of the steps of the present method are best done in rapid succession so that they cooperate to achieve a tighter barrier against water intrusion.

These and other features and their advantages of the present invention will become apparent to those skilled in the art of reconditioning interior surfaces of commercial and industrial facilities from a careful reading of the following detailed description of embodiments accompanied by the following drawings.

BRIEF DESCRIPTION OF THE DRAWINGS

In the figures.

DETAILED DESCRIPTION OF EMBODIMENTS

The present invention is a composition made by a process and a method for improving robustness of the interior surface of a building that is exposed to frequent cleaning. Improved robustness means that the interior surface will not require reconditioning or refurbishment to restore its physical integrity as soon after an interior surface that was reconditioned in accordance with the prior art; conversely the surface with improved robustness will maintain its physical integrity longer than an interior surface reconditioned in accordance with the prior art.

Figure 1:
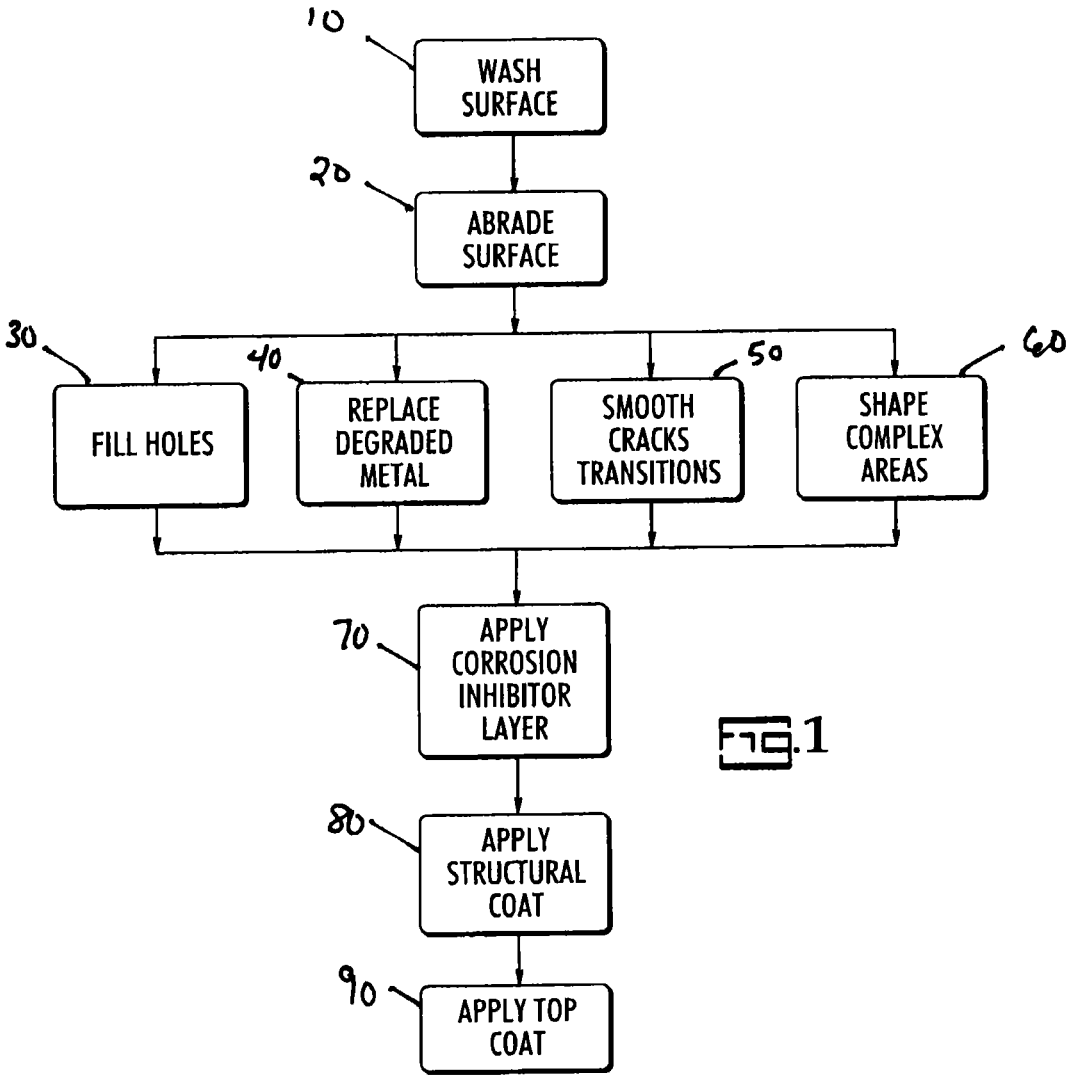
FIG. 1 is a flowchart of the present process, according to an embodiment of the present invention.

Referring now to the drawings, FIG. 1 is a flow chart of the steps that may be used in reconditioning an interior surface to make it more robust against frequent cleaning. The first step 10 is to wash the surface to remove dirt and grease.

Abrading the surface is a next step 20. If the interior surface is not clean and free of evidence of deterioration, it should first be made so by abrading the surface to remove loose paint, corrosion and other deleterious materials. The surface may be abraded manually or by using hand tools. If the surface is an insulated metal panel, it is abraded to sound substrate and then wiped clean with a solvent, such as an inorganic solvent. The resulting surface may have a textured profile from the abrasion of about 0.5 mil, that is, the difference between adjacent high and low elevations of the surface are no more than 0.5 mils.

If there are holes, cracks, or gaps in the surface, they must be repaired. This is a next step (30) that depends on the condition of the interior surface. Holes, cracks and gaps may exist to provide penetrations for piping that is no longer needed or may be the result of damage from forklift tines or hand trucks. Holes and gaps are filled with a filler material, such as an acrylic sealant or polymeric concrete for small holes, or, for larger holes, epoxies that cure rapidly within no more than six hours.

If the underlying surface is metal that is so badly corroded or damaged that, after removal, large holes are left, leaving a need for replacement structural support, sheet metal may be attached as a next step 40. Sheet metal may be secured to the surrounding good metal in any suitable manner, such as by using pop rivets. When sheet metal is applied adjacent to a portion of the remaining surface, the edges of sheet metal may be folded to form a slot-and-groove-interface so there is a suitable overlap of old and new metal.

After abrading, filling holes and replacing degraded metal, cracks and transitions are smoothed in step 50 with putties made of clay or epoxy, such as putties with thixotropic agents sold under the brand name of J-B STIK WELD sold by J-B Weld Company and MAXIM Fast Set Bonding Adhesive sold by Evercoat, for example. All edges, such as where new metal meets old metal, that create topographic transitions, are smoothed by the application of putty.

Step 60 is to shape complex areas. Complex areas in the surface occur where corroded areas surround pipe penetrations or where several structural elements come together and present sharp angles and multiple changes in surface direction. These areas may be re-formed into smoother shapes by using expandable foams, such as the foam sold under the trademark GREAT STUFF by Dow Chemical, for example. The foams are applied in accordance with the manufacturer's directions and then sculpted or shaped (during cure) to a smooth, slowly transitioning surface that is easily cleaned and facilitates water run-off rather than trapping water.

After the surface has been prepared as described above, with all loose material removed and the surface imperfections and complex areas turned into a single, continuous, smoothly varying topographic surface, the surface is then ready for a step 70, applying a corrosion inhibiting coat. This coating may contain pigments such as micaceous iron oxide or aluminum flakes. These pigments are desirable because their morphologic structure naturally creates longer pathways for water to travel. Delaying the time it takes water to reach the underlying surface enhances the robustness and durability of the present coating system against degradation from frequent cleaning, particularly with water and detergents that may contain chlorine.

After applying the corrosion-inhibiting layer to the interior surface, a structural layer is applied in a next step 80. At this point, the surface should have all seams resulting from changes in material smoothly bridged by foams or putties, leaving no discontinuities in the surface that are abrupt but only smooth, gradual changes from one area of the surface to the next area.

A structural polymeric coating is applied to the cleaned and smoothed interior surface in such a way that the surface is rendered completely continuous and even smoother. The polymeric coating is applied in layers, thicker in corners, seams and transitional areas and thinner elsewhere. The coating is preferably polyurea or an elastomeric urethane, and may be applied as thin as 40 mils but as thick as 250 mils, particularly in corners and across transitional areas. The greater application thickness in corners and transitional areas helps round those corners and smooth those transitions to make the surface direction change in corners less sharp and more rounded.

By smooth and continuous it is meant that the surface with the polymeric coating and top coating have no cracks, gaps, pits or holes, nor discontinuities or changes in topography that are not gradual, that the surface has no transitions with a radius of curvature that is small enough to trap water when the surface is in a vertical orientation. Smoothness means both that the surface have no pits or scratches or other marks deep enough that they are wetted by water and have no changes in topography that are discontinuous, but rather that changes in the surface topography are continuous. A smooth, continuous surface sheds water quickly as the water will not wet it or be trapped anywhere on it, and will be glossy, having a waxed appearance, with no imperfections in the surface to trap water.

The structural coating to be applied is a polymer, such as a polyurea or elastomeric urethane catalyzed at the time it is sprayed onto the surface with an isocyanate catalyst. The catalyst is mixed with the polymer on exit from the equipment to facilitate application.

Although the polymeric coating may take many hours to dry completely, as soon as the polymeric coating is dry to the touch, usually within a few minutes, a top layer is applied over it as step 90. Top layer may makes the surface water-resistant, and preferably water-resistant to hot water such as water that is at least 140° F. up to 180° F., and most preferably resistant to chlorine and ultraviolet light. The top layer may be a moisture-cured urethane, aliphatic Polyurea, or polyaspartic acid. Water-resistant means that water will not wet the surface after the top layer is applied and allowed to dry.

The top coat is applied by spraying it on top of the structural coat. While not wishing to be bound by theory, it is believed that by applying the top layer as soon as the structural polymeric layer is dry to the touch, the two coatings cross-link thereby helping to avoid delamination and the creation of gaps between layers through which water may migrate.

Figure 2:
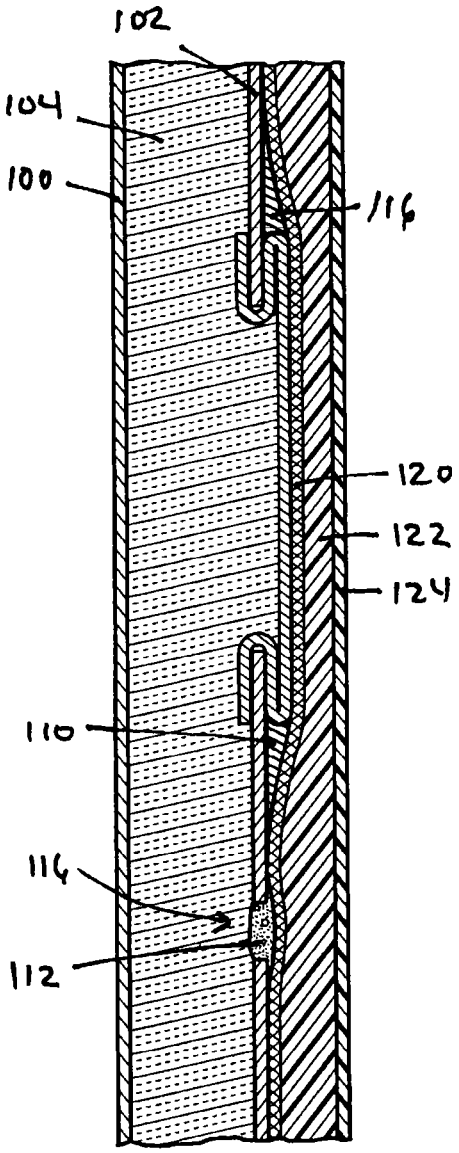
FIG. 2 is a cross sectional view of a reconditioned interior surface showing a metal panel replacement, according to an embodiment of the present invention.
Figure 3:
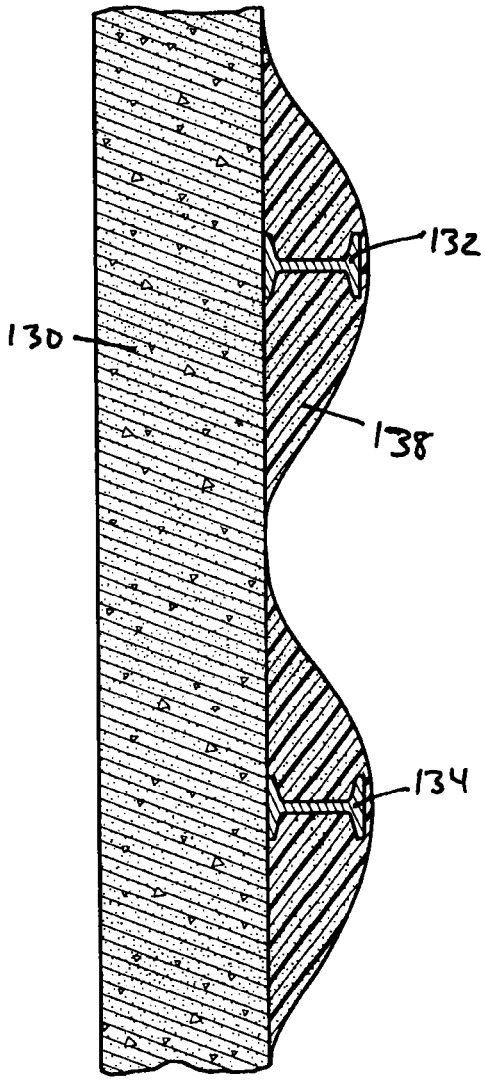
FIG. 3 is a cross section showing the reconfiguring of a portion on an interior surface with pre-existing topographic complexities, according to an embodiment of the present invention.

FIGS. 2 and 3 are cross-sections of portions of a wall after reconfiguring the topography of the interior surface. FIG. 2 is a cross-section of a metal panel with an exterior metal surface 100 and an interior metal surface 102 and a layer of insulation 104 there between. A replacement metal panel 108 is fitted into a hole left in interior metal surface 102 where corrosion had so deteriorated inner metal surface 102 that it had to be cut away. The edges of replacement panel 108 are folded to receive the edges 110 of interior metal surface 102 in a slot-and-groove configuration. Pop rivets (not shown) may be used to secure replacement panel 108 in place.

Putty 110 may be used to smooth the transition between interior surface 102 and replacement panel 108, and expandable foam 112 may be used to fill smaller holes 116. A corrosion inhibitor layer 120 is followed by a structural layer 122 and then a top coat 124. The exterior topography may curve but is otherwise smooth and continuous.

FIG. 3 is a cross-sectional view of a wall made of masonry 130 with two I-beams 132, 134, fastened to it, resulting in a surface that is complex in that it has many sharp angles and places where water can be trapped. Accordingly, expanding foam 138 is used to fill in around I-beams 132, 134, and has then been shaped to make a smooth and continuous surface 140 from which water will easily run off.

An important goal of the process described herein is to create a barrier between the fundamental surface and the water used to clean the surface, a barrier that is harder for water to penetrate but which sheds water more readily and is devoid of surface features that accumulate water. The present process and system can be applied to a new wall or a degraded one, and leaves the wall more robust, that is, better able to resist degradation resulting from frequent cleaning than the original wall.

What is claimed is:

1. A method for improving the robustness of an interior surface of a building to frequent cleaning, said method comprising the steps of:

(a) abrading said surface of a building to remove loose material;

(b) wiping said abraded surface clean with a solvent before applying said polymer coating;

(c) applying in layers a polymeric coating to said surface to make said surface smooth and continuous, thicker in corners and transitional areas so as to increase the radius of curvature of corners and transitional areas; and (d) as soon as said polymeric coating is dry to the touch, applying a top layer to said polymeric coating, said top layer being resistant to water.

2. The method as recited in claim 1, wherein said polymeric coating is a polyurea.

3. The method as recited in claim 1, wherein said polymeric coating is an elastomeric urethane.

4. The method as recited in claim 1, wherein said top layer is resistant to water heated to at least 140° F.

5. The method as recited in claim 1, wherein said top layer is resistant to detergent.

6. The method as recited in claim 1, wherein said top layer is resistant to chlorine.

7. The method as recited in claim 1, wherein said top layer is resistant to ultraviolet light.

8. The method as recited in claim 1, wherein said top layer is a moisture-cured urethane.

9. The method as recited in claim 1, wherein said top layer is polyaspartic acid.

10. The method as recited in claim 1, further comprising the step of applying a corrosion-inhibiting compound to said surface before applying said polymeric coating.

11. The method as recited in claim 10, wherein said corrosion inhibitor is aluminum flakes.

12. The method as recited in claim 10, wherein said corrosion inhibitor is micaceous iron oxide.

13. The method as recited in claim 1, further comprising the step of filling gaps and topographic transitions in said surface to cover said gaps and smooth said topographic transitions.

14. The method as recited in claim 13, wherein said filling step further comprises the steps of:

(a) applying an expanding foam to said gaps; and (b) after said foam cures, shaping said foam to transition smoothly from adjacent surfaces.

15. The method as recited in claim 13, wherein said filling step further comprises the step of applying putty to said topographic transitions in said surface.

16. The method as recited in claim 13, wherein said filling step further comprises the step of applying sheet metal to said gaps.

17. A method for improving the robustness of an interior surface of a building to frequent cleaning, said method comprising the steps of:

(a) filling gaps and smoothing transitions in said surface;

(b) applying in layers a polymeric coating to said surface to make said surface smooth and continuous, applying said coating thicker in corners and transitional areas so as to increase the radius of curvature of corners and transitional areas; and (c) as soon as said polymeric coating is dry to the touch, applying a top layer to said polymeric coating, said top layer being resistant to water.

18. The method as recited in claim 17, wherein said filling step further comprises the steps of:

(a) applying an expanding foam to said gaps; and (b) after said foam cures, shaping said foam to transition smoothly to adjacent surfaces.

19. The method as recited in claim 17, wherein said filling step further comprises the step of applying putty to said topographic transitions in said surface.

20. The method as recited in claim 17, wherein said filling step further comprises the step of securing sheet metal to said surface.

21. The method as recited in claim 17, wherein said applying step further comprises the step of applying said polymer coating in a thickness that ranges from 40 mils to 250 mils.

22. A method for reconditioning a building interior surface, said method comprising the steps of:

(a) abrading the interior surface of a building to remove loose material;

(b) wiping said abraded surface clean;

(c) filling gaps and transition areas in said wiped surface to provide a continuous surface;

(d) applying a corrosion inhibiting compound to said smooth continuous surface;

(e) as soon as said adhesion promoting compound is applied, applying in layers a polymeric coating to said surface to make said surface smooth and continuous, thicker in corners and transitional areas to increase the radius of curvature of corners and transitional areas; and (f) as soon as said polymeric coating is dry to the touch, applying a top layer to said polymeric coating, said top layer resistant to water.

23. The method as recited in claim 22, wherein said polymeric coating is a polyurea or elastomeric urethane.

24. The method as recited in claim 22, wherein said top layer is resistant to detergent.

25. The method as recited in claim 22, wherein said top layer is resistant to chlorine.

26. The method as recited in claim 22, wherein said top layer is resistant to ultraviolet light.

27. The method as recited in claim 22, wherein said top layer is polyaspartic acid, aliphatic polyurea or a moisture-cured urethane.

28. The method as recited in claim 22, wherein said gap filling step further comprises the step of securing sheet metal to said surface.

29. The method as recited in claim 22, wherein said corrosion inhibitor is aluminum flakes or micaceous iron oxide.

30. The method as recited in claim 22, wherein said wiping step further comprises wiping said surface with a solvent.

31. The method as recited in claim 22, wherein said polymer coating ranges in thickness from 40 mils to 250 mils.

32. The method as recited in claim 22, wherein said filling step further comprises the steps of:

(a) applying an expanding foam to said gaps; and (b) after said foam cures, shaping said foam to transition smoothly from adjacent surfaces.

33. The method as recited in claim 22, wherein said filling step further comprises the step of applying putty to said topographic transitions in said surface.

* * * * *